United States Patent [19]

Knauff

[11] 4,327,518

[45] May 4, 1982

[54] INERTIAL DEVICE FOR SIGHT AND SOUND EFFECTS IN ROTATING APPARATUS

[76] Inventor: Robert J. Knauff, 819 N. Gardner St., West Hollywood, Calif. 90046

[21] Appl. No.: 125,032

[22] Filed: Feb. 27, 1980

[51] Int. Cl.[3] ..... A63H 33/26

[52] U.S. Cl. ..... 46/228; 46/61; 46/50

[58] Field of Search ..... 46/61, 60, 228, 226, 46/179, 227, 229, 50

[56] References Cited

U.S. PATENT DOCUMENTS

| | | | |
|---|---|---|---|
| 1,732,085 | 10/1929 | Fixen | 46/226 |
| 2,726,483 | 12/1955 | Hughes et al. | 46/228 |
| 3,081,578 | 3/1963 | Mosher | 46/61 X |
| 3,233,359 | 2/1966 | Salayka | 46/61 |
| 3,263,361 | 8/1966 | Bowden | 46/61 |
| 3,452,474 | 7/1969 | Zopf | 46/228 |
| 3,645,037 | 2/1972 | Baginski et al. | 46/179 X |
| 4,178,714 | 12/1979 | Tsen et al. | 46/228 |

FOREIGN PATENT DOCUMENTS

| | | | |
|---|---|---|---|
| 1282194 | 12/1962 | France | 46/228 |
| 23149 | of 1908 | United Kingdom | 46/60 |

*Primary Examiner*—Gene Mancene
*Assistant Examiner*—Mickey Yu
*Attorney, Agent, or Firm*—William H. Maxwell

[57] ABSTRACT

An inertia device which controls and produces a sensory effect as a function of a differential in the angular velocities between primary and secondary bodies rotating on a common axis with a friction drive therebetween, commutated by differential speeds of rotation, and with the sound effect functional as a result of said differential speeds of rotation, and all of which is operative through rotation of the primary body in either direction of rotation with the transfer of kinetic energy into the secondary body for control and operation of the sensory effect.

20 Claims, 8 Drawing Figures

INERTIAL DEVICE FOR SIGHT AND SOUND EFFECTS IN ROTATING APPARATUS

BACKGROUND

There are numerous mechanisms which display rotating elements or wheels that spin at varying velocities, and especially toys such as tops, yoyos and "Frisbies" in the category of toys or amusement devices, educational devices such as gyroscopes, and skates in the category of athletic devices; or any like toy and/or device whether of an amusement or serious nature where a rotating element exists and is revealed to view. Although a wheel may spin at varying speeds, the wheel per se is not operable in itself to establish sight and sound effects, except for the visible turning of spokes or the like at low speeds and perhaps the extraneous sounds of bearings and peripheral wind noise at high speeds. Therefore, the sight and sound of a conventional wheel is rather insignificant and not at all distinctive or indicative of the wheel velocity attained. Accordingly, it is an object of this invention to provide an inertial device and friction drive means therefor, by which kinetic energy is made available to operate sensory effect producing means to be sensed by persons operating the device or in proximity thereto.

In the many wheel applications of the prior art, angular momentum and the fly-wheel phenomenon is ever present and is the principle which stabilizes tops, yoyos, "Frisbies" and gyroscopes. These various devices rely principally upon a singular rotating mass supported on anti-friction bearings or the like. In other words, the mass has heretofore moved as one body and as friction free as possible. However, friction is ever present and it is a general object of this invention to advantageously employ the ever present friction in drive means which stores and/or makes kinetic energy available to perform the functions or producing sight and/or sound effects. In carrying out this invention there is a secondary inertial body in addition to a primary rotating device, and a friction drive means or bearing therebetween by which the secondary inertial body is driven from rotation of the primary rotating device.

It is an object of this invention to provide a visible lighting effect associated with a rotating device, and which produces dots and dashes of light is an arcuate pattern dependent upon the relative angular velocities of primary and secondary bodies revolving on a common axis. In carrying out this invention, there is a secondary inertia wheel operable with a primary inertia wheel which comprises a housing that carries a power supply that is commutated to periodically energize a light emitting means. In practice, a self sufficient battery operated Light Emitting Diode (LED) circuit is controlled by the differential speeds of rotation between the said primary and secondary bodies.

Another object of this invention is to provide an audible effect associated with a rotating device, and which produces sound of varying volume and/or pitch dependent upon the relative angular velocities of primary and secondary bodies revolving on a common axis. In carrying out this invention, there is a secondary inertia wheel operable in the form of a siren rotor within a cage formed by a primary inertia wheel which comprises the body of the device, and which is operable at differential speed of rotation from the said primary wheel or body.

It is also an object of this invention to provide a cooperative combination of the two aforesaid sight and sound effect means, incorporated in a device which comprises primary and secondary inertial bodies, and wherein a reversible friction drive means is provided for transfering kinetic energy into the said secondary body from said primary body.

SUMMARY OF INVENTION

This invention relates to a sensory effect producing device, involving either sight or sound, or both; and each dependent upon a common source of control and/or energy for the operation thereof. This invention is characterized by primary and secondary inertia means independently rotatable on a common axis and the later driven from the former through a drive means operating frictionally therebetween. The primary inertia means is the body of a device such as a top, a yoyo, a "Frisbie", a gyroscope, or any like wheel that rotates through manual operation or through a suitable drive means, usually an external drive means applied thereto. The secondary inertia means is concentrically coaxial with the primary inertia means, and is a simple wheel or the rotor of the sound effect means as it is disclosed herein. The drive means comprises a shaft upon which the secondary inertia means rotates relative to the primary inertia means, and which is journaled in friction bearings carried by said primary inertia means. The shaft operates a commutator means for the control of sight effect means and for the periodic emission of light and comprised of a battery operated LED circuit made operative by a centrifugal switch. This device is put into use by spinning the primary inertia means in either direction of rotation, and various effects obtained by varying the speed and direction of the rotation.

The foregoing and other various objects and features of this invention will be apparent and fully understood from the following detailed description of the typical preferred form and application thereof, throughout which description reference is made to the accompanying drawings.

PREFERRED EMBODIMENT

Figure 1:
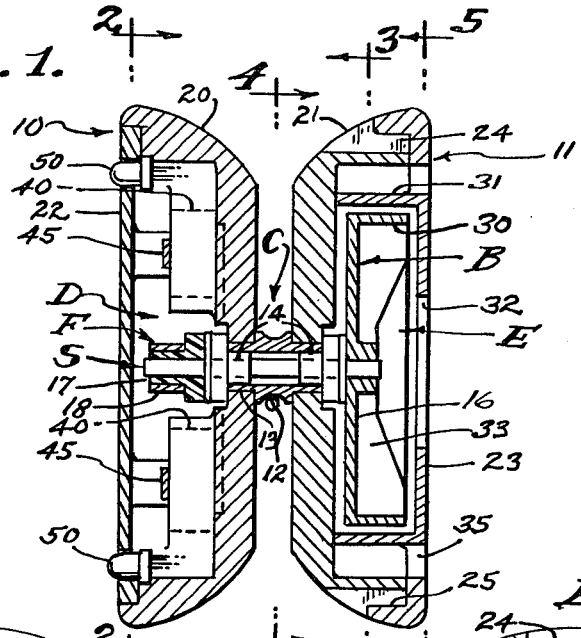
FIG. 1 is a sectional view taken through the central axis of a yoyo embodying the features of the present invention.
Figure 2:
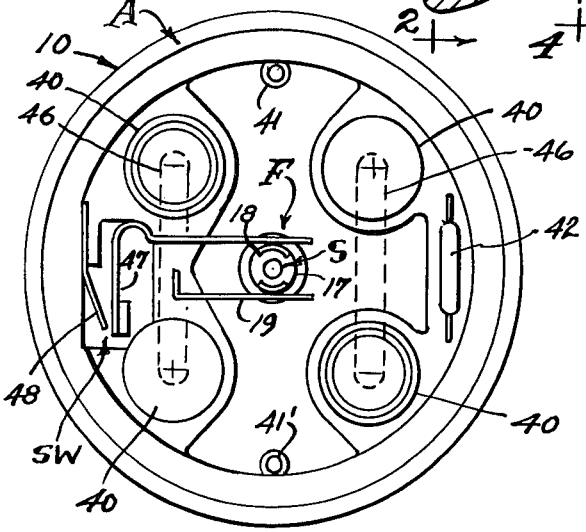
FIGS. 2 and 3 are transverse sectional views taken as indicated by lines 2—2 and 3—3 on FIG. 1.
Figure 3:
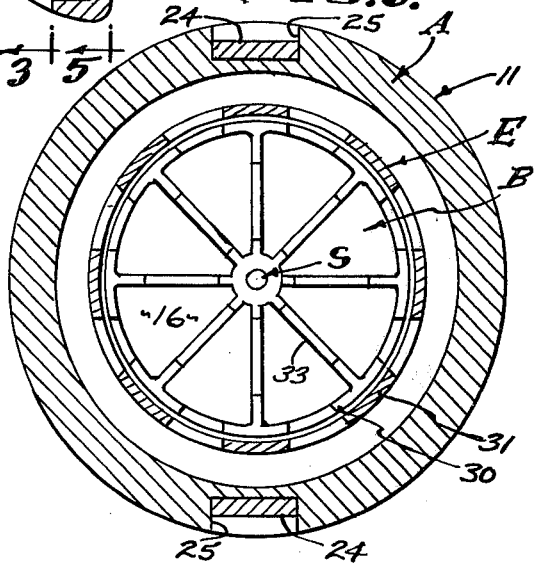
Figure 4:
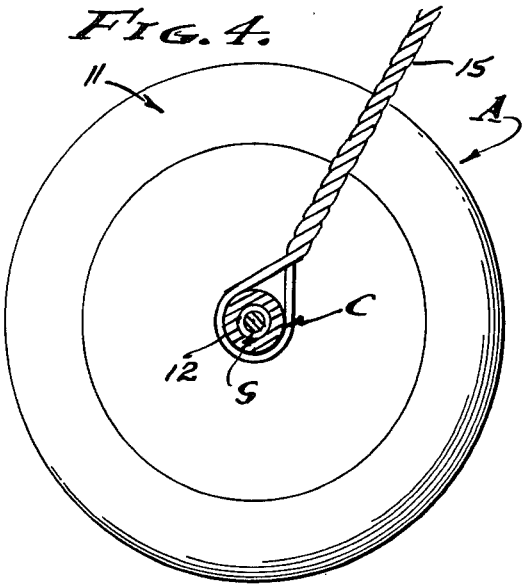
FIG. 4 is a sectional view taken as indicated by line 4—4 on FIG. 1.
Figure 5:
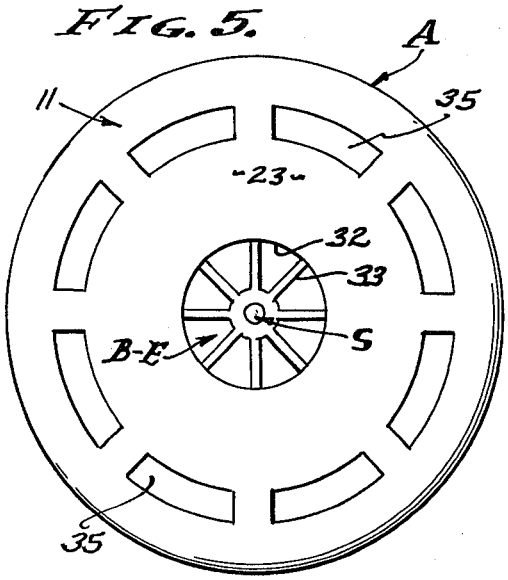
FIG. 5 is end view taken as indicated by line 5—5 on FIG. 1.

In its preferred form this invention is shown applied to a yoyo which comprises the primary inertia means A of the device. And the secondary inertia means B is carried on a shaft S concentrically coaxial with the means A to be driven by drive means C on a common rotational axis. The sensory effect means comprises sight effect means D and/or sound effect means E carried by either the means A or means B; and as shown the said effect means D and E are carried by the primary inertia means A which involves the body of the device, and in the form illustrated carried by the yoyo per se.

Characteristically, the yoyo is bilaterally symetrical and comprised of axially spaced inertia wheels 10 and 11 joined by a hub 12, the said wheels establishing housings that accommodate the secondary inertia means B, the sight and sound effect means D and E, the drive means C, the commutator means F, and the switch means SW, all as hereinafter described.

The primary inertia means A comprised of the axially spaced wheels 10 and 11 is constructed of a pair of like outwardly belled housings 20 and 21 closed by covers 22 and 23 respectively. Securement of the covers is by means of diametrically positioned latch means shown as comprised of depressible spring fingers 24 projecting from the covers and having hooked engagement with openings 25 in the housings, all of which is common practice. It is significant however that the wheels 10 and 11 are hollow and that the chambers therein are accessible. Also that the acceptable weight of a yoyo presently varies between 52 and 70 grams, a weight range which is feasible with the present invention.

In accordance with the present invention, the drive means C is incorporated with the hub 12 without changing the essential prior art features thereof. That is, the exterior of the hub can remain the same as a typical prior art hub that is of spindle form having oppositely faced shoulders against which the wheels 10 and 11 are pressed over cylindrical trunnions 13; press fitted and/or swedged. However, with the present invention the hub 12 is tubular so as to pass the shaft S with frictional bearing engagement. The shaft S can bear directly on the hub 12, or as is preferred for quality control a shaft of precise outside diameter is journaled in spaced bushings 14 of precise inside diameter, pressed into opposite ends of the said hub. The bushings 14 are of lubricant impregnated porous metal or of Nylon, or the like; having a determinable coefficient of friction with shaft S and thereby establishing a torsional effect between the hub 12 and the shaft S. Accordingly, a drive effect is attained in order to rotate the shaft S from rotation of the primary inertia means A. The primary inertia means of the yoyo is rotated in the usual manner by means of an operating string 15 looped over the hub 12 and wound thereon between the confining pair of wheels 10 and 11.

The secondary inertia means B is comprised of a fly-wheel 16 carried on one end of shaft S within a chamber or wheel housing, in this case the chamber of housing 21 and within the confines of wheel 11. In its basic configuration the fly-wheel 16 is a simple disc-shaped member with a peripheral rim as circumstances require for storing the desired amount of kinetic energy as caused by the angular momentum imposed by the drive means C.

The commutator means F is a rotating switch revolved by the shaft S and carried thereby within a chamber of a wheel housing, in this case the chamber of housing 20 and within the confines of wheel 10. it is to be understood that in the case of a top, a "Frisbie" or a roller skate wheel, all components of this device are accommodated within one singular chamber. However, in the preferred yoyo embodiment it is most convenient to separate the secondary inertia means B from the sight effect means D, and also to combine the secondary inertia means B with the sound effect means E as next described. Accordingly, the commutator comprises a drum 17 pressed onto the shaft S and made of a dielectric material carrying circumferentially spaced contact bars 18 engageable with slip fingers 19 carried by the wheel 10 of the primary inertia means A. In practice, there are diametrically opposite conductive bars 18, conductively interconnected and each occupying 90° of arc. The slip fingers 19 are at least a pair and angularly spaced with respect to rotation of the drum and bars 18 to simultaneously engage the same for conduction, preferably a pair of parallel springs carried by the housing of wheel 10 to embrace and biased inwardly to make intermittent electrical contact as the inertia means A and B revolve one with respect to the other. Thus, on and off timing is equal at constant velocity and all of which can be varied as circumstances require.

In accordance with the preferred form of this invention, the sound effect means E is combined with the secondary inertia means B to provide an acoustical siren wherein streams of air are driven against a relatively rotating circumferentially perforated element to produce sound at a pitch and amplitude dependent upon angular velocity. As shown, the peripheral rim 30 of fly-wheel 16 is interrupted by a series of equally spaced openings operating concentrically within a perforated shell 31 carried by the cover 23 of housing 21. The cover 23 has a central inlet opening 32, and the fly-wheel 16 has radial vanes 33 to drive streams of air radially outward through the interrupting perforations 34 in the rim 30. The shell 31 is of substantially smaller diameter than the housing 21, there being an angular and flared plenum exhausting air and transmitting sound through a series of outlet openings 35 in the cover 23. Since it is not uncommon for a yoyo to spin at 8000 RPM or more, the primary inertia means thereof will be accellerated rapidly to an effective differential speed with respect to the secondary inertia means B, and thereby produce an audible siren sound.

In accordance with this invention, the sight effect means D is a self contained electrical means carried by either the inertia means A or B and controlled by rotation and the relative revolvement of means A to means B. In its preferred form the sight effect means D is accommodated in the chamber of housing 20 and enclosed by the cover 22, and thereby carried by the primary inertia means A. As shown, the means D includes a battery power supply 40, at least one Light Emitting Diode (LED) 41 (41'), a protection resistor 42, the commutator means F, and a centrifugally actuated on-off switch means SW. Molded into the body housing 20 of wheel 10 are the necessary recesses and/or pockets to receive and mount the components 40–42 and parts of the switch means SW, the cover 23 of wheel 10 being molded with compatable features to retain said components and switch means in their operating positions.

The power supply 40 comprises four 1½ volt batteries of low profile cylinder form, carried in an equally spaced circular series of pockets and captured therein by the cover 22. Series busses 45 and 46 are circumferentially alternated in the housing 20 and cover 22 to couple the batteries in series for 6 volt application to the LED 41 (41'). The LED 41 (41') and resistor 42 are positioned in suitable recesses diametrically opposite slots that position the slip fingers 19 and leaf spring 47 of switch SW. The permanent elements of the circuit can be cemented or fused into place with solvent, or held secure by the installation of the cover 21. Radially outward centrifugal force pressures the leaf spring 47 into engagement with contact 48, so as to complete the electrical circuit only when the primary inertia means A is rotating at substantial speed. The positions of the parts is selected for static balance and imbalance is compensated for by molding suitable weight into the housing 21. An aperture in the cover 22 permits slight projection of the LED lens 50, so that it is readily visible without being vulnerable.

Figure 6:
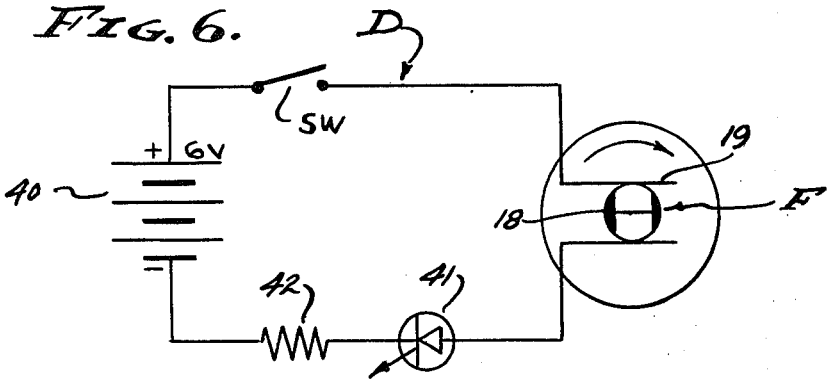
FIGS. 6, 7 and 8 are electrical diagrams illustrating the sight effect means of present invention, in its basic form and in its combination forms.

Referring to FIG. 6 of the drawings and to the basic circuitry, the single On-Off LED 41 can be of any color and is in series circuit through On-Off switch SW, commutator means F, and protective resistor 42. Upon centrifugal actuation of switch SW, spring 47 engages contact 48 so that the positive potential of battery 40 is applied through the commutator slip fingers 19 to the anode of the LED 41 in series with the current limiting resistor 42 and to the negative potential of the battery. The On-Off pulse rate of the LED is dependent upon the differential in angular velocity between the primary and secondary inertia means.

Figure 7:
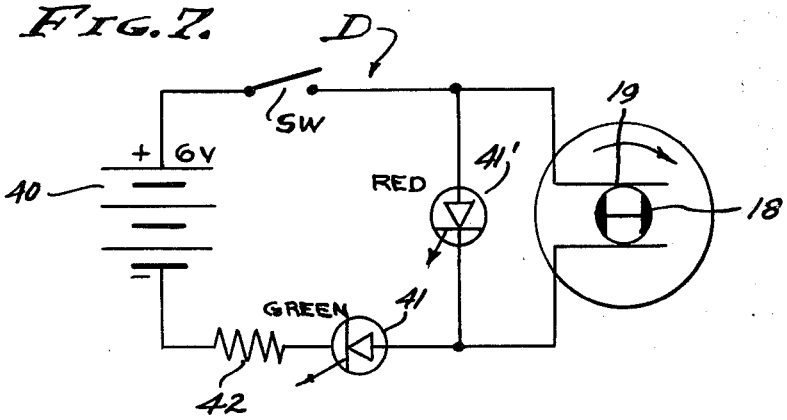

Referring now to FIG. 7 of the drawings, there is a High-Low LED combined with an On-Off LED, utilizing the above described basic circuitry. Accordingly, LED's 41 and 41' having different voltage characteristics (1.5 v and 2.2 v) are employed; for example a "green" LED 41 and a "red" LED 41'. In this combination circuit the LED 41' is shunted across the commutator slip fingers 19 to be in series with the positive potential of battery 40 and LED 41; both protected by the series resistor 42. When switch SW is closed and commutator switch F opened, the positive potential of battery 40 flows first through red LED 41' and then through green LED 41, so that the green LED 41 is in a "Low" visual state due to the 1.5 forward voltage drop of red LED 41' which allows less voltage/current to pass through the green LED 41; operating current is reduced thereby dimming the green LED 41. However, when commutator switch F is closed, the red LED 41' is shunted Off which allows an additional 1.5 volts to pass to the green LED 41 so as to put it in the "High" visual state. The LED's 41 and 41' are current sensitive devices, and in this combination the green LED 41 responds visibly to both High and Low currents, while the red LED 41' goes totally On and Off.

Figure 8:
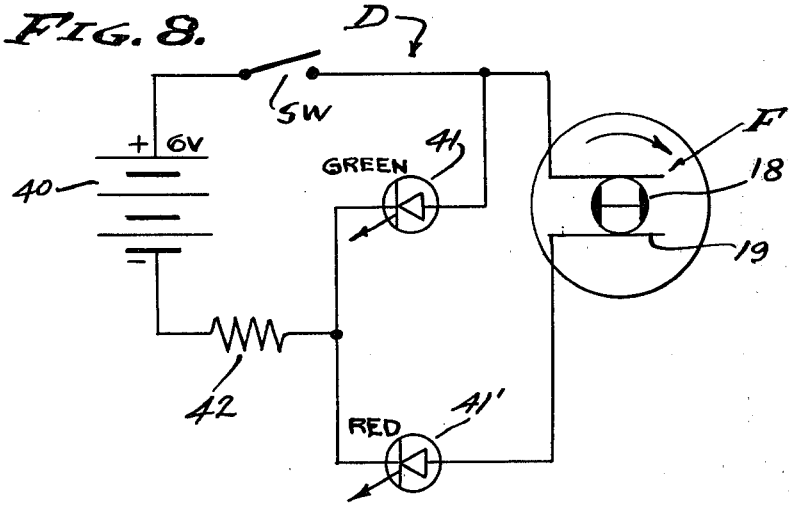

Now, referring to FIG. 8 of the drawings, again there is a High-Low LED combined with an On-Off LED, utilizing the above described basic circuitry. As shown, there is a "green" LED 41 and a "red" LED 41'. In this combination circuit the LED 41 is in parallel with the LED 41' so as to share the same limited current as determined by the protective resistor 42. When commutator switch F is opened, red LED 41' is Off, full voltage is applied through green LED 41 so that it is in the High visual state. However, when commutator switch F is closed, red LED 41' is On simultaneously with green LED 41 which must now share the current, and consequently LED 41 goes dim while LED 41' in bright; the red LED using current more efficiently than the green LED due to its lower forward voltage drop of 1.5 v as compared with 2.2 v (typically).

From the foregoing it will be understood how the primary and secondary inertia means are utilized to control and operate sensory means for sight and sound effects. The differential in angular velocity between the primary and secondary inertia means is determined by the effectiveness of the drive means C and its friction bearings, and also by thrust washers 14' disposed between the relatively rotatable inertia means to check end play. The sensory effect means, audio and visual, are advantageously employed singularly and in combination as shown and described.

Having described only a typical preferred form and application of my invention, I do not wish to be limited or restricted to the specific details herein set forth, but wish to reserve to myself any modifications or variations that may appear to those skilled in the art as set forth within the limits of the following claims.

I claim:

1. An inertia device for sensory effect and including, primary and secondary free spinning inertia means rotating on a common axis with a friction drive means therebetween, and said inertia means being rotatable at differential angular velocities and said velocity differential being applied to a sight effect means carried by one of said inertia means and comprised of a battery in series circuit with an instantaneously illuminating On-Off diode visible from the device and a commutator switch in said circuit and operated by differential rotation of the primary and secondary inertia means for On-Off control thereof when the primary inertia means is rotatively accelerated.

2. The inertia device for sensory effect as set forth in claim 1, wherein the primary inertia means comprises spaced wheels of housing configuration, wherein the sight effect means is housed in one wheel, and wherein the secondary inertia means comprises a flywheel is housed and operable within the other wheel.

3. The inertia device for sensory effect as set forth in claim 1, wherein the sensory effect means is a sight effect means carried by one of said inertia means and comprises a battery in series circuit with the instantaneously illuminating On-Off light emitting diode visible from the device, a protective resistor and the commutator switch in said circuit and operated by differential rotation of the primary and secondary inertia means.

4. The inertia device for sensory effect as set forth in claim 1, wherein the sensory effect means is a sight effect means carried by one of said inertia means and comprises a battery in series circuit with the instantaneously illuminating On-Off light emitting diode, and an instantaneously illuminating High-Low light emitting diode in shunt circuit across the communtator switch, there being a protective resistor in series with said diodes.

5. The inertia device for sensory effect as set forth in claim 1, wherein the sensory effect means is a sight effect means carried by one of said inertia means and comprises a battery in series circuit with the instantaneously illuminating On-Off light emitting diode, and an instantaneously illuminating High-Low light emitting diode shunt circuit across the battery, there being a protective resistor in series with each of said diodes.

6. The inertia device for sensory effect as set forth in any one of claims 3 through 5, wherein a centrifugally actuated switch means is in series circuit to close when at least one of said inertia means is rotatively accellerated.

7. The inertia device for sensory effect as set forth in claim 1, wherein the sensory effect means is a sight effect means carried by the primary inertia means and comprises a battery in series circuit with the instantaneously illuminating On-Off light emitting diode visible from the device, and a protective resistor in said circuit.

8. The inertia device for sensory effect as set forth in claim 1, wherein the sensory effect means is a sight effect means carried by the primary inertia means and comprises a battery in series circuit with the instantaneously illuminating On-Off light emitting diode, and an instantaneously illuminating High-Low light emitting diode in shunt circuit across the commutator switch, there being a protective resistor in series with said diodes.

9. The inertia device for sensory effect as set forth in claim 1, wherein the sensory effect means is a sight effect means carried by the primary inertia means and comprises a battery in series circuit with the instantaneously illuminating On-Off light emitting diode, and an instantaneously illuminating High-Low light emitting diode in shunt circuit across the battery, there being a protective resistor in series with each of said diodes.

10. The inertia device for sensory effect as set forth in any one of claims 7 through 9, wherein a centrifugally actuated switch is in the series circuit to close when the primary inertia means is rotatively accellerated.

11. An inertia device for multisensory effects and including, primary inertia means comprised of a pair of axially spaced wheels of housing configuration and a hub extending between said wheels for driving engagement with an operating string, a free spinning secondary inertia means rotating on a common axis within the housing configuration of the primary inertia means, friction drive means for the secondary inertia means and comprising friction support of a shaft therefrom rotatably through said hub, a first sight effect sensory means housed within one of said wheels and comprising a battery in series circuit with light emitting means visible from the device and a commutator switch in said circuit and operated by differential rotation of the primary and secondary inertia means, and a second sound effect sensory means housed within the other of said wheels and in the form of a siren comprising members of the primary and secondary inertia means wherein streams of air are driven against a relatively rotating circumferentially perforated element to produce sound at a pitch and amplitude dependent upon differential angular velocity between the primary and secondary inertia means.

12. The inertia device for multisensory effects as set forth in claim 11, wherein the light emitting means is an instantaneously illuminating diode in series with a protective resistor.

13. The inertia device for multisensory effects as set forth in claim 11, wherein the light emitting means includes an instantaneously illuminating On-Off light emitting diode in said series circuit and an instantaneously illuminating High-Low light emitting diode in a shunt circuit across the commutator switch, there being a protective resistor in series with the said diodes.

14. The inertia device for multisensory effects as set forth in claim 11, wherein the light emitting means includes an instantaneously illuminating On-Off light emitting diode in said series circuit and an instantaneously illuminating High-Low light emitting diode in shunt circuit across the battery, there being a protective resistor in series with each of said diodes.

15. The inertia device for multisensory effects as set forth in any one of claim 11 through 14, wherein a centrifugally actuated switch means is in the series circuit to close when at least one of said inertia means is rotatively accellerated.

16. A yoyo for multi sensory effects and including, a pair of axially spaced wheels comprising a primary inertia means, a hub extending between said wheels for external driving engagement with an operating string, a secondary inertia means rotating on a common axis with the primary inertia means, friction drive means comprising friction support of a shaft rotatably in said hub, a first sight effect sensory means carried by one of said yoyo wheels and comprising a battery in series circuit with light emitting means visible from the device and a commutator switch operated by differential rotation of the primary and secondary inertia means, and a second sound effect sensory means carried by the other one of said yoyo wheels and in the form of a siren comprising members of the primary and secondary inertia means wherein streams of air are driven against a relatively rotating circumferentially perforated element to produce sound at a pitch and amplitude dependent upon differential angular velocity between the primary and secondary inertia means.

17. The yoyo for multi-sensory effect as set forth in claim 16, wherein the light emitting means is an instantaneously illuminating diode in series with a protective resistor.

18. The yoyo for multi-sensory effect as set forth in claim 16, wherein the light emitting means includes an instantaneously illuminating On-Off light emitting diode in said series circuit and an instantaneously illuminating High-Low light emitting diode in shunt circuit across the commutator switch, there being a protective resistor in series with the said diodes.

19. The yoyo for multi-sensory effect as set forth in claim 16, wherein the light emitting means includes an instantaneously illuminating On-Off light emitting diode in said series circuit and an instantaneously illuminating High-Low light emitting diode in shunt circuit across the battery, there being a protective resistor in series with each of said diodes.

20. The yoyo for multi-sensory effects as set forth in any one of claims 16 through 19, wherein a centrifugally actuated switch is in the series circuit to close when at least one of said inertia means is rotatively accellerated.

* * * * *